United States Patent [19]

Hurvitz

[11] 4,016,699

[45] Apr. 12, 1977

[54] DECORATIVE GRILLE STRUCTURE

[76] Inventor: Arnold Hurvitz, 327 Rosemary Lane, Narbeth, Pa. 19072

[22] Filed: Aug. 27, 1975

[21] Appl. No.: 608,075

[52] U.S. Cl. ..... 52/663; 52/626; 52/507

[51] Int. Cl.[2] ..... E06B 7/08

[58] Field of Search ..... 52/656, 663, 660, 667, 52/507, 455, 456, 475, 473, 626; D54/2 B; D13/1 J

[56] References Cited

UNITED STATES PATENTS

| | | | |
|---|---|---|---|
| 1,854,144 | 4/1932 | Shrosbree | 52/656 |
| 3,039,574 | 6/1962 | Miller | 52/663 |
| 3,086,629 | 4/1963 | Blitzer | 52/663 |
| 3,125,196 | 3/1964 | Fenner | D54/2 B |
| 3,317,227 | 5/1967 | Nijhuis | 52/656 |
| 3,603,627 | 9/1971 | Kaffel | 52/656 |
| 3,621,631 | 11/1971 | Cutler | 52/663 |
| 3,798,863 | 3/1974 | Latson | 52/656 |

*Primary Examiner*—Price C. Faw, Jr.
*Assistant Examiner*—Henry Raduazo
*Attorney, Agent, or Firm*—Jacob Trachtman

[57] ABSTRACT

A decorative grille having a substantially rectangular frame in which each of the side members includes a substantially C-shaped channel section and a mounting flange extending substantially coplanar with a leg of the channel section. A plurality of spaced, parallel rods extend between two parallel side members of the frame. The rods have end portions which extend into the channel sections of the side members and are secured thereto by screws extending through the base of the channel sections and threaded into the rods. A plurality of plastic decorative grille elements are mounted in rows between adjacent rods, and between each of the other two side members of the frame and the adjacent rods. The grille elements which are adjacent a rod are interconnected to each other through the rods. The grille elements which are along a side member of the frame extend into the channel section of the side member and are secured therein by a screw extending through the base of the channel section and threaded into the grille element.

2 Claims, 7 Drawing Figures

FIG. 1
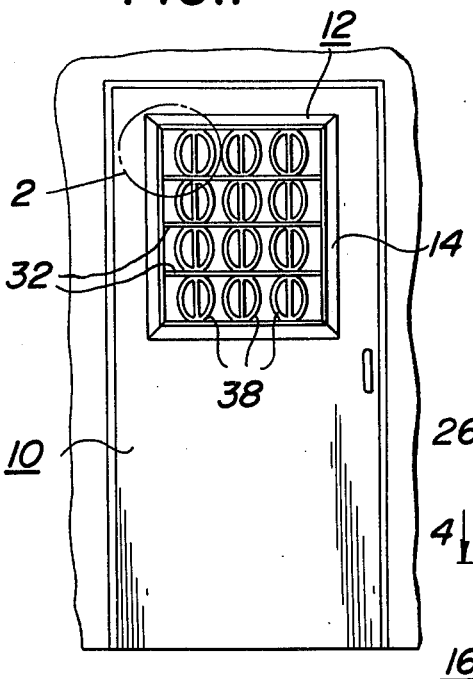
FIG. 2
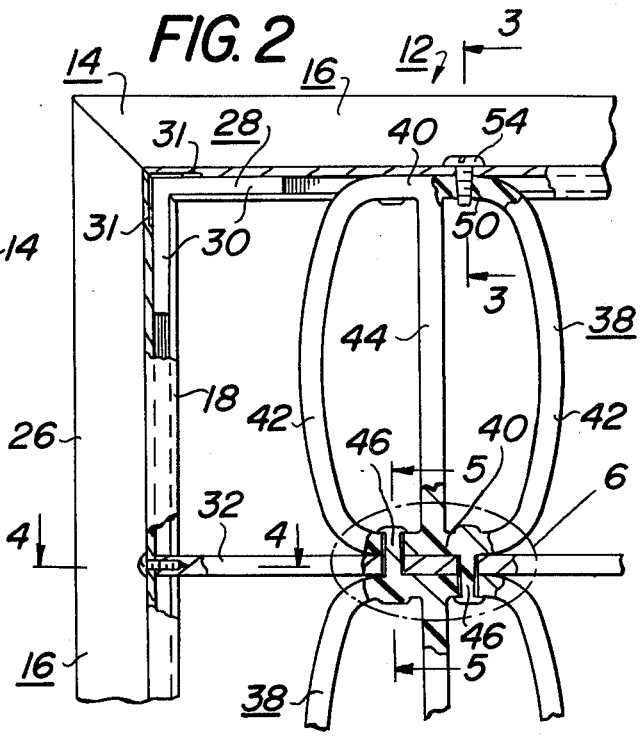
FIG. 3
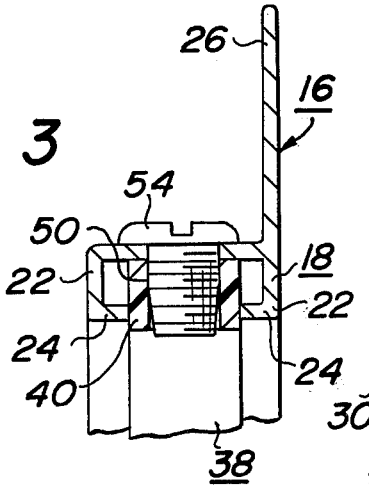
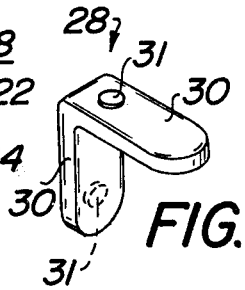
FIG. 7
FIG. 4
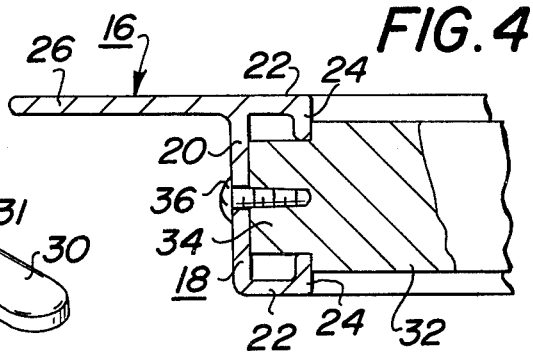
FIG. 5
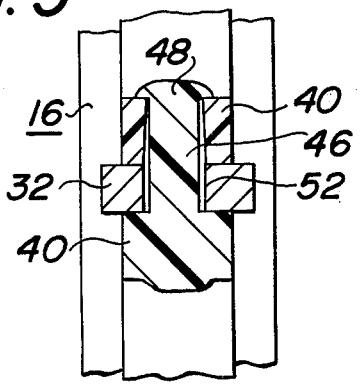
FIG. 6
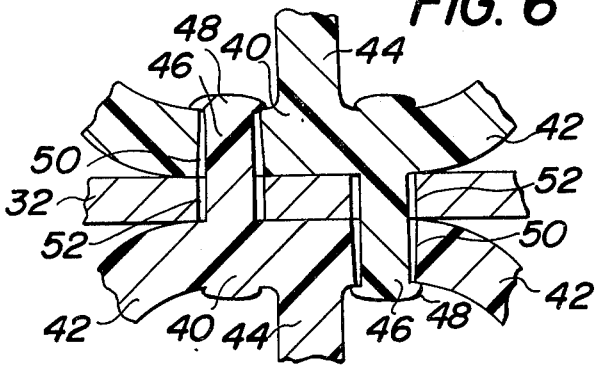

DECORATIVE GRILLE STRUCTURE

The present invention relates to a decorative grille and particularly to such a grille which is adapted to be mounted in a door, window or the like.

It is often desirable to provide a decorative grille in an opening in a door, window or the like. Also, it is often desirable to have a decorative grille which can be mounted in an opening in a door or window rather than being an integral part of the door or window. In addition, since doors and windows come in different sizes, it is desirable to have a decorative grille which can be easily made in different sizes to fit a particular door or window. Therefore, it is desirable to have a decorative grille which is made up of a minimum number of different types of parts and which can be easily assembled to provide a decorative grille which is relatively inexpensive to manufacture.

Therefore, it is an object of the present invention to provide a novel decorative grille.

It is another object of the present invention to provide a decorative grille which is made up of a minimum number of different parts.

It is still another object of the present invention to provide a decorative grille which is made up of a minimum number of different parts and which can be easily assembled to provide a grille which is inexpensive to manufacture.

It is a futher object of the present invention to provide a decorative grille which can be easily made in different sizes to fit a desired size opening in a door, window or the like.

Other objects will appear hereinafter.

The invention accordingly comprises the features of construction, combination of elements, and arrangements of parts, which will be exemplified in the construction hereinafter set forth, and the scope of the invention will be indicated in the claims.

For a fuller understanding of the nature and objects of the invention, reference should be had to the following detailed description taken in connection with the accompanying drawing in which:

FIG. 1 is a front elevation view of a door having the decorative grille of the present invention;

FIG. 2 is an enlarged front elevation view, partially broken away, of the portion of the grille within the circle 2 of FIG. 1;

FIG. 3 is a sectional view taken along line 3—3 of FIG. 2;

FIG. 4 is a sectional view taken along line 4—4 of FIG. 2;

FIG. 5 is a sectional view taken along line 5—5 of FIG. 2;

FIG. 6 is an enlarged view of the portion of the grille within the circle 6 of FIG. 2; and FIG. 7 is a perspective view of the L-shaped corner connector used to connect the side members of the frame.

Referring to FIG. 1, there is shown a door 10 having therein a decorative grille 12 of the present invention. The door 10 may be a storm door or any other type of door requiring a decorative grille. Although the door 10 is shown with only one grille 12, it may include any desired number of the grilles. Also, the grille 12 can be used in windows or any other structure in which a decorative grille is desired.

The grille 12 comprises a rectangular frame 14 formed of four side members 16. Each of the side members 16 includes a substantially C-shaped channel section 18 having a base 20, a pair of parallel legs 22 extending from the base 20, and feet 24 extending toward each other from the ends of the legs 22. The ends of the feet 24 are spaced apart. A mounting flange 26 extends substantially perpendicularly from the base of the channel section 18 and coplanar with one of the legs 22 of the channel section. The side members 16 are of a metal, preferably extruded aluminum. The ends of the side member 16 are mitered so that the ends of adjacent side members can be brought into abutting relation. The side members 16 are connected together by L-shaped metal corner connectors 28 shown in FIG. 7. As illustrated in FIG. 2, each leg 30 of a corner connector 28 fits tightly within the end of the channel section 18 of one of the adjacent side members 16. As illustrated in FIGS. 2 and 7, the legs 30 of the corner connectors 28 each have a protrusion 31 which engages the channel section 18 into which its leg 30 is received to firmly secure the side member 16 together.

A plurality of rods 32 extend between and are secured to the vertical side members 16 of the frame 14. The rods 32 are uniformly spaced apart between and parallel to the horizontal side members 16 of the frame 14. As shown in FIG. 4, each of the rods 32 is of a width slightly narrower than the width of the channel section 18 of the side member 16, but wider than the spacing between the feet 24 of the channel section 18. The rods 32 are of a length to engage the outer surfaces of the feet 24 of the channel section 18. Each end of each rod 32 has a projection 34 extending into the channel section 18 between the feet 24 and engaging the inner surface of the base 20. A screw 36 extends through a hole in the base 20 of the channel section 18 and is threaded into a hole in the projection 34 to secure the rods 32 to the vertical side members 16.

A plurality of decorative grille elements 38 are mounted in rows between adjacent rods 32 and between the horizontal side member 16 and the adjacent rods 32. As shown, there are three of the grille elements 38 in each row and the grille elements 38 are also arranged in vertical columns. However, any number of the grille elements 38 can be provided in each row depending on the size of the grille 12. Each of the grille elements 38 is made of a plastic and has two straight horizontal sides 40, two curved vertical sides 42 and an intermediate rod 44 extending vertically between the horizontal sides 40 and intermediate the vertical sides 42. A pin 46 having an enlarged head 48 is integral with and projects vertically outwardly from each of the horizontal sides 40. The two pins 46 of each grille element 38 are positioned at opposite sides of the intermediate rod 44. Each of the horizontal sides 40 has a hole 50 therethrough at the side of the intermediate rod 44 opposite the side at which the pin 46 is located. Each of the holes 50 is tapered so as to be smaller in diameter at the inner surface of the horizontal side 40 than at the outer surface. The diameter of the hole 50 at the inner surface of the horizontal side 40 is smaller than the diameter of the head 48 of the pin 46.

The grille elements 38 fit between the rods 32 with each horizontal side 40 engaging a rod. As shown in FIGS. 5 and 6, the pin 46 projecting from each horizontal side 40 extends through a hole 52 in the adjacent rod 32 and through the hole 50 in the horizontal side 40 of the adjacent grille element 38 in the next row. Since the pin 46 and its head 48 are of a plastic material, the head 48 can be compressed and forced through the smaller hole 50 in the horizontal side 40 of the adjacent grille element 38. The tapered shape of the hole 50 helps permit compression of the pin head 48. When the pin head 48 passes completely through the hole 50, the head 48 expands back to its normal size to prevent the pin from being pulled back through the hole 50. Thus, the grille elements 38 are secured to each other and to the frame 14 through the rods 32.

The grille elements 38 which are between the horizontal side members 16 of the frame 14 and the adjacent rods 32 have one horizontal side 40 engaging the rod and secured to the adjacent grille element 38 through the rod in the manner previously described and as shown in FIGS. 2, 5 and 6. At the other horizontal side 40 of the grille element 32, the pin 46 is removed, such as by being cut off at the outer surface of the horizontal side. This other horizontal side fits into the channel section 18 of the adjacent frame side member 16 between the feet 24 as shown in FIGS. 2 and 3. A self-threading screw 54 extends through a hole in the base 20 of the channel section 18 and is threaded into the hole 50 in the horizontal side 40 of the grille element 38 to secure the grille element directly to the side member 16 of the frame 14.

Although the grille 12 is shown as having four rows of grille elements 38 with three grille elements in each row, the number of grille elements 38 may vary depending on the size of the frame 14 and the size of the grille elements. Also, the shape and decorative design of each grille element 38 may be different from that shown as long as the grille element has upper and lower sides with a headed pin projecting from and a hole in each of such sides.

Thus, the grille 12 is made up of a minimum number of different parts, i.e., the side member 16, the corner connector 28, the rod 32, the grille element 38, and a few screws. The side members can be cut from elongated extruded stock and can be made of any length depending on the desired size of the grille 12. The rods 32 are cut from rod stock, and the grille elements 38 are molded plastic parts. Thus, the parts of the grille 12 are relatively inexpensive to form. The grille 12 is assembled by forcing the legs 30 of the corner connectors 28 into the ends of the channel sections 18 of the side member 16 to form the frame 14. The rods 32 are inserted between the two vertical side members 16 and secured thereto by the screws 36. The grille elements 38 are then mounted between the rods 32 and the horizontal side members 16. Along the rods 32, the grille elements 38 are merely snapped together through the rods. At the horizontal side members 16, the grille elements 38 are secured in place by the screws 54. Alternately, the rods 32 and grille elements may be assembled and secured together first, after which this assembly can be secured with the side members 16 to complete the grille 12. Thus, the grille 12 of the present invention is made up of a minimum number of different parts which are relatively inexpensive to make, and the grille 12 is relatively easy to assemble providing a structure which is relatively inexpensive to manufacture.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

What is claimed is:

1. A decorative grille structure comprising, a frame having four side members connected together at their ends in the form of a rectangle, each of said side members having an identical substantially C-shaped channel section, the channel section of each of the side members includes a base, legs extending from the base, and feet extending toward each other from the ends of the legs with the ends of the feet being spaced apart, and a plurality of L-shaped corner connectors each having a pair of legs, the side members being connected together by the L-shaped corner connectors with each leg at each corner connector fitting tightly within the channel section at the end of a side member, a plurality of spaced, parallel rods extending between and secured to two opposed parallel side members, each of the rods having an end portion extending into the channel section of the two opposed side members between the feet of the channel section, and a screw extending through a hole in the base of each channel section and threaded into a hole in the respective end portion of the rod to secure the rod to the side member, and a plurality of decorative grille elements mounted in rows between adjacent rods and between each of the other two parallel side members and an adjacent rod, each of said grille elements having top and bottom ends including attachment means comprising a pin integral with and projecting from the grille element and a hole in the grille element spaced from the pin, each of the grille elements which extend to a rod being connected therewith by having the pin of its attachment means extend through the rod to the hole of the attachment means of a grille element on the other side of the rod and each of the grille elements which extends to one of the other side members has an end extending into and being secured to the channel section of the side member between the feet of the channel section with the pin of its attachment means removed, and a screw extending through the base of the channel section and being threaded into the hole of the attachment means of the grille element to secure the grille element to the side member.

2. A decorative grille structure in accordance with claim 1 in which each of the rods is of a width no greater than the width of the channel sections of the side members but greater than the distance between the ends of the feet of the channel section, and the end portions of the rods are of a width no greater than the distance between the ends of the feet of the channel sections.

* * * * *